US005819980A

United States Patent [19]

Hill

[11] Patent Number: 5,819,980

[45] Date of Patent: Oct. 13, 1998

[54] GURGLE AND SLOSH FREE CANTEEN

[76] Inventor: Myles L. Hill, 633 Eltone Rd., Jackson, N.J. 08527

[21] Appl. No.: 760,319

[22] Filed: Dec. 4, 1996

[51] Int. Cl.[6] ..... B65D 23/02; B65D 90/04; B67D 5/42

[52] U.S. Cl. ..... 220/719; 220/404; 220/530; 220/723; 222/386.5; 222/390

[58] Field of Search ..... 220/578, 9.1, 404, 220/403, 530, 529, 625, 723, 719, 720; 222/386.5, 390; 16/332, 324

[56] References Cited

U.S. PATENT DOCUMENTS

| | | | |
|---|---|---|---|
| 949,163 | 2/1910 | Stapley | 222/390 |
| 953,373 | 3/1910 | Clark | 222/390 |
| 980,686 | 1/1911 | Whine | 16/332 |
| 1,235,550 | 8/1917 | Carmody | 222/386.5 |
| 2,123,731 | 7/1938 | Kahn | 222/390 |
| 2,728,494 | 12/1955 | Hobson | 222/386.5 |
| 3,162,336 | 12/1964 | Erickson | 222/386.5 X |
| 3,224,345 | 12/1965 | Doetsch | 220/720 X |
| 3,698,595 | 10/1972 | Gortz et al. | 220/723 X |
| 4,544,083 | 10/1985 | Schroeder | 222/390 X |
| 5,238,150 | 8/1993 | Williams | 222/386.5 X |

*Primary Examiner*—Allan N. Shoap
*Assistant Examiner*—Niki M. Kopsidas
*Attorney, Agent, or Firm*—Ira M. Adler, Esq

[57] ABSTRACT

A canteen minimizes sloshing or gurgling in a container containing liquid, by mechanically displacing air in an internal plastic bag which contains the liquid. The canteen permits a user to reduce the air space within the plastic bag by turning a knob which is attached to a turnscrew, which, in turn, raises a platform, thereby compressing the bag. With the air displaced from the bag, the liquid does not slosh or gurgle when the canteen is moved. A locking assembly is provided to lock the thumbscrew in place.

1 Claim, 2 Drawing Sheets

GURGLE AND SLOSH FREE CANTEEN

FIELD OF THE INVENTION

The present invention relates to a canteen which holds liquids and avoids the liquids from sloshing around or gurgling noisily when the user moves about or drinks.

BACKGROUND OF THE INVENTION

Previously when a law enforcement officer acting on a stakeout or military personnel required to move about quietly, drink liquid from a canteen, a gurgling noise would emanate due to the trapped air in the canteen, thereby creating a risk of exposure of their presence. The present invention avoids this defect by forcing air from the canteen before the liquid is drunk or the user moves about.

While several previous inventions have consisted of a sliding member on a threaded shaft, such as U.S. Pat. No. 4,074,833 by Otto, Sr. and U.S. Pat. No. 5,137,185 by Mitchell, no prior invention has used this mechanism to reduced the sloshing or gurgling of liquid in a container.

U.S. Pat. No. 4,550,848 by Sucato attempts to reduce sloshing by means of internal apertures.

OBJECTS OF THE INVENTION

It is an object of the present invention, therefore, to minimize sloshing and gurgling of liquid in a canteen, especially during instances where lack of noise is a requirement, such as during police stakeouts or military operations.

SUMMARY OF THE INVENTION

As will become clear from the following description, the present invention minimizes sloshing or gurgling in a container containing liquid, by mechanically displacing air in an internal bag which in turn contains the liquid.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
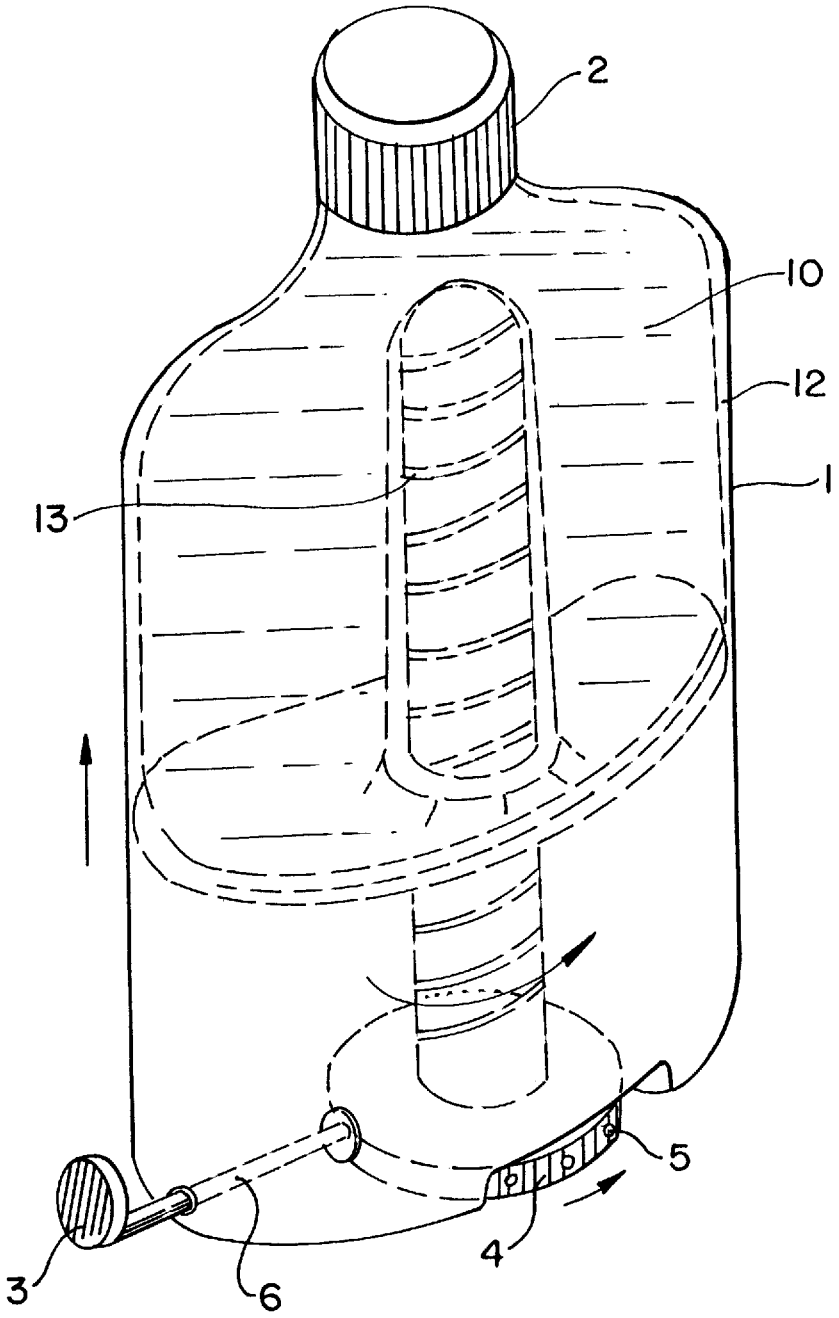
FIG. 1 is a perspective view of the outside of the canteen, showing the knob and its locking mechanism.

Referring to the drawings, the invention is seen in FIG. 1, consists of a standard water container or canteen, 1, and a canteen cap, 2. A knob, 4, is turned which causes an internal bag, 12, containing liquid, 10, to collapse, thereby displacing air. A tab, 3, and rod, 6, arrangement is used to lock the knob, 4, by plunging into a plurality of holes, 5, on the periphery of the rim of the knob. When the internal bag is collapsed to its maximum extent, air is displaced by the remaining liquid. In this condition, drinking from the canteen results in no gurgling sound and moving the container results in no sloshing noise.

Figure 2:
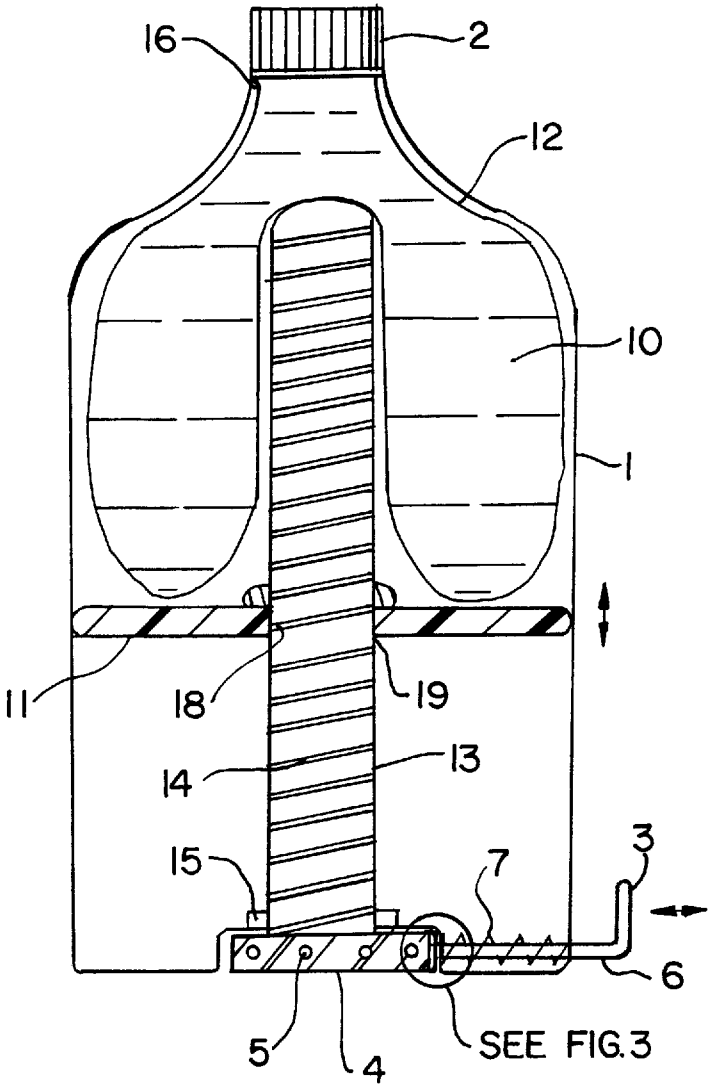
FIG. 2 is a horizontal cross-section of the invention.

FIG. 2 is a cross section of the invention containing a liquid, 10. In use, the user turns the knob, 4, from which extends a turnscrew, 13, which has a thread, 14, running its length almost to the top. A platform, 11, having a central hole, 19, is internally threaded, 18, to mesh with the turnscrew.

As seen in FIG. 1, the platform, 11, rises and lowers within the container as the knob is turned. The platform is prevented from rotating, as its shape is the same as the inner walls of the container, hence it is only free to undertake longitudinal motion.

As is further seen in FIG. 2, as the platform, 11, is raised a plastic bag, 12, containing liquid, 10, and affixed to the inner surface of the neck of the canteen, 16, is compressed by the raising of the platform, 11, thereby displacing air from the inner bag, 12.

Figure 3:
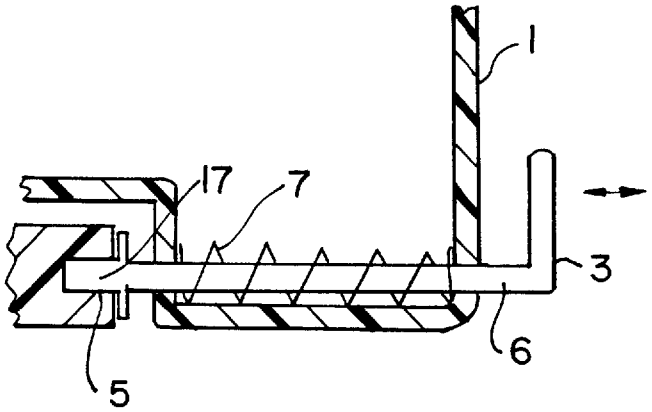
FIG. 3 is a detail of the locking mechanism.

As seen in FIG. 2 and shown in detail in FIG. 3, the knob, 4, and turnscrew, 13, are locked in place by having the tip, 17, of rod, 6, being inserted into one of a plurality of holes, 5, in the knob, 4. The rod is held in place by a spring means, 7. As can further be seen, the turnscrew, 13, is kept from detaching by meshing with the internal thread, 18, of the platform, 11. As the thread, 14, does not run completely to the top of the turnscrew, 13, it can not detach when fully extended. The spring, 7, is affixed to the rod where it is located inside the canteen, thereby preventing removal of the rod, but still permitting the rod to engage the holes, 5, in the perimeter of the knob.

As seen in FIG. 2, a locking ring, 15, located at the base of the turnscrew, 13, prevents the turnscrew and knob from detaching from the canteen.

What I claim is:

1. A liquid holding container which reduces sloshing and gurgling comprising:

a hollow oblong container having an opening on its top and a small bottom hole with said bottom hole being at the center of a cylindrical indentation at the center of the bottom of the container, and a hole on its lower side;

a removable cap secured to the container at the top opening;

an inner plastic bag, having a small opening at one end and having the periphery of the opening attached to the inside of the container at its upper opening;

a cylindrical turnscrew, having a bottom and top end, rotatably passing through the opening in the bottom of the container, being approximately the length of the container and the bottom end extending outward, said turnscrew having lengthwise threads on its outside surface, with said threads extending almost to the top of the turnscrew, thereby preventing the knob and turnscrew from detaching from the container;

a knob affixed to the bottom end of the turnscrew, said knob having a plurality of radial holes on its periphery, the radius of the knob being slightly smaller than the cylindrical indentation at the bottom of the canteen;

a platform, having a central round hole with inner threads, which mesh with the threads on the outer surface of the turnscrew, said platform shaped to approximately conform to the inner surface of the container, such that rotation around the axis of the turnscrew is impeded and the platform can only rise and fall when the knob is turned;

a means of locking the knob and affixed turnscrew to a set position, said means consisting of a rod inserted into the hole in the lower side of the container, such that one end of the rod can be inserted into one of the plurality of radial holes on the periphery of the knob, thereby locking the knob in place, said rod being held in place by means of a spring concentrically affixed to said rod and located between the inside of the inner surface of the container and the inside of the cylindrical depression in the bottom of the container.

* * * * *